United States Patent [19]

Dien

[11] Patent Number: 4,717,390

[45] Date of Patent: Jan. 5, 1988

[54] METHOD FOR DYEING LEATHER WITH WATER-SOLUBLE SULPHO GROUP-CONTAINING SULPHUR DYES

[75] Inventor: Michel Dien, Rixheim, France

[73] Assignee: Sandoz Ltd., Basel, Switzerland

[21] Appl. No.: 823,927

[22] Filed: Jan. 30, 1986

[30] Foreign Application Priority Data

Jan. 30, 1985 [DE] Fed. Rep. of Germany ..... 3502955
Jan. 30, 1985 [DE] Fed. Rep. of Germany ..... 3502954

[51] Int. Cl.[4] ..... D06P 3/32
[52] U.S. Cl. ..... 8/436
[58] Field of Search ..... 8/436

[56] References Cited

U.S. PATENT DOCUMENTS

| | | | |
|---|---|---|---|
| 2,228,369 | 1/1941 | Scholler | 8/436 |
| 3,273,954 | 9/1966 | Wachsmann et al. | 8/12 |
| 3,334,960 | 8/1967 | Abel | 8/54 |
| 4,273,243 | 6/1981 | Lach et al. | 8/436 |

FOREIGN PATENT DOCUMENTS

| | | |
|---|---|---|
| 2638236 | 3/1978 | Fed. Rep. of Germany . |
| 705335 | 3/1954 | United Kingdom . |
| 769174 | 2/1957 | United Kingdom . |
| 1204059 | 9/1970 | United Kingdom . |
| 1502966 | 8/1978 | United Kingdom . |
| 1526332 | 9/1978 | United Kingdom . |

OTHER PUBLICATIONS

Journal of the Society of Dyers and Colorists, No. 77 (1961) pp. 646–656.

*Primary Examiner*—Paul Lieberman
*Assistant Examiner*—John F. McNally
*Attorney, Agent, or Firm*—Gerald D. Sharkin; Richard E. Vila; Thomas C. Doyle

[57] ABSTRACT

Tanned leather is penetration-dyed from aqueous medium with hydrospluble sulpho group-containing sulphur dyes in the presence of dye-substantive uptake assistants and may be used as a substrate for further coloration processes, mainly dyeings and printings, in particular with anionic or basic dyes; in a variation of the process for overdyeing, in particular of thin leathers, the penetration-dyeing may also be carried out in the absence of the dye-substantive uptake assistant.

28 Claims, No Drawings

METHOD FOR DYEING LEATHER WITH WATER-SOLUBLE SULPHO GROUP-CONTAINING SULPHUR DYES

The invention relates to a process for the penetration dyeing of tanned leather and to the use of the penetration-dyed leather as a substrate for further colouring treatments, particularly overdyeing with hydrosoluble dyestuffs.

Thus the invention provides a process for the penetration dyeing of tanned leather, wherein the leather is dyed with a hydrosoluble sulphogroup-containing sulphur dye from an aqueous medium in the presence of a dye-substantive uptake assistant.

Any kind of tanned leather as commonly used as a substrate for dyeing from aqueous media may be used for the process of the invention, particularly grain leather (e.g. nappa from sheep, goat or cow and box leather from calf or cow), suede leather (e.g. velours from sheep, goat or calf and hunting leather), split velours (e.g. from cow or calf skin), buckskin and nubuk leather; further also wool-bearing skins and furs (e.g. fur-bearing suede leather). The leather may have been tanned by any usual tanning method, in particular vegetable, mineral, synthetic or combined tanned (e.g. chrome tanned, zirconyl tanned or aluminium tanned). If desired, the leather may also be retanned and/or fatted; for retanning, there may be used any tanning agent conventionally employed for retanning, e.g. mineral, vegetable or synthetic tanning agents e.g. chromium, zirconyl or aluminum derivatives, oak, quebracho or mimosa extract, aromatic syntanes, copolymers of (meth)acrylic acid compounds or urea/formaldehyde resins. Before dyeing the leather may also be fatted, and for this purpose any conventional fatting agents may be employed, in particular such as are commonly applied from aqueous media, e.g. animal, vegetable or mineral fats, oils, resins or waxes and their chemical modification products, e.g. hydrogenation, oxidation, saponification or sulphonation products of animal and vegetable fats and oils or chlorination and/or sulphonation products of mineral fats or oils and synthetic fatting agents. By the term "sulphonation" is meant generally the introduction of a sulpho group including also the formation of a sulphato group (="sulphating") and the introduction of a sulpho group by reaction with a sulphite or $SO_2$ (="sulphiting"). Such fatting agents are described e.g. in F. Stather, "Gerbereichemie und Gerbereitechnologie", Akademieverlag Berlin, 1967, 4th edition, in chapter 21 on pages 517–535. For fatting it is preferred to use fat liquor emulsions in which the fat liquor is emulsified by means of an emulsifier and/or by chemical modification.

The emulsifiers may be non-ionic, anionic or cationic, depending on the fatting agent, and are also well known in the art; they are described for example in the above mentioned publication of Stather. If the leather is fatted before the dyeing process of the invention, it is preferred to use a non-ionic or more preferably an anionic fat-liquor (preferably wherein at least some of the fatting agent and/or of the optionally present emulsifier contains a sulpho group and/or a carboxy group). The fatting agents and emulsifiers mentioned in the above publication of Stather are incorporated herein by reference. Particularly worth mentioning are the saponification and/or sulphonation products of tallow, train oil, neat's foot oil, olive oil, castor oil, rape seed oil, linseed oil, coconut oil, wood oil, cottonseed oil, sesame oil, corn oil and Japanese tallow and their mixtures with non-modified fats or oils and/or with wool-fat, beeswax, ceresin, mineral oil or optionally sulphonated paraffins.

The leathers may be of various thicknesses. Thus there may be used very thin leathers such as bookbinders' leather or glove leather (nappa), leather of medium thickness such as shoe upper leather, garment leather and leather for handbags or also thick leathers such as shoe sole leather, furniture leather, leather for suitcases, for belts and for sport articles; hair-bearing leathers and furs may also be used. After tanning and before the dyeing process of the invention the pH of the leather is advantageously set to values in the range of 4 to 9 (the leather is "neutralized"); depending on the thickness of the leather and on the compactness of its fibrous structure, there may be chosen an optimum pH-range, mainly as follows: for grain leather and thick leathers (such as nubuk) pH-values in the range of 4 to 6; for suede leathers, split velours and for very thin leathers, pH-values in the range of 5 to 9; for intermediately dried suede leathers and intermediately dried split velours, the pH-values may range in the scope of 6 to 9. Preferably, however, the pH-range is kept at neutral to weakly acidic values, more preferably within the range of 4.5 to 7. For the adjustment of the pH-value of the leather, there may be employed conventional assistants; for tanned leather of acidic character the pH may be adjusted by addition of suitable bases, e.g. ammonia or ammonium bicarbonate or alkali metal salts of weak acids, e.g. sodium formate, sodium acetate, sodium bicarbonate, sodium carbonate or sodium bisulphite of which sodium formate and ammonia are preferred. Sodium carbonate and bicarbonate are usable in particular as second bases for the exact adjustment of the superficial pH-value of the leather. For retanning—in so far as a retanning is carried out—the pH is kept preferably in the range of 4 to 7.

The dyes to be used according to the invention are hydrosoluble sulpho group-containing sulphur dyes, especially so called Bunte salts as defined e.g. in Venkataraman "The Chemistry of Synthetic Dyes", vol VII, 1974, Akademic Press, in chapter II on pages 35–68, preferably such as defined and listed in the Colour Index under the headings "Solubilized Sulphur Dyes" and "Condense Sulphur Dyes". They may be employed in the usual commercial forms.

As dye-substantive uptake assistants come into consideration, in general, any such assistants as are usually employed in dyeing with anionic dyestuffs from aqueous media, mainly highly oxyethylated and optionally quaternated surface active fatty amines or fatty aminoalkylamines. The fat radical in the fatty amines or fatty aminoalkylamines is advantageously an aliphatic, linear hydrocarbon radical with at least 12 carbon atoms, preferably alkyl or alkenyl with 16–22 carbon atoms; the alkylene bridge in the fatty aminoalkylamines contains advantageously 2 to 6 carbon atoms and is preferably a linear polymethylene, preferably ethylene, propylene or hexamethylene of which propylene is particularly preferred. The degree of oxyethylation is advantageously such that at least 20 moles of ethylene oxide are added per mole of fatty amine or fatty aminoalkylamine; preferably the degree of oxyethylation is in the range of 20 to 110, in particular for quaternated products in the range of 20 to 70, preferably 25 to 50, and for non-quaternated products in the range of 50 to 110, preferably 70 to 110. By the quaternation there are preferably introduced methyl or ethyl groups (preferably methyl) and the counter-ion is preferably the one corresponding to the quaternating agent employed for quaternation, preferably methosulphate, ethosulphate or a halide (iodide, bromide or preferably chloride). Preferred dye-substantive uptake assistants correspond to the average formula

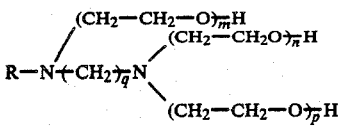

(I)

in which

R signifies alkyl or alkenyl with 16 to 22 carbon atoms, q is a whole number from 2 to 6, preferably 3, m, n and p are each at least 1 and the sum m+n+p is 20 to 110, or to quaternation products thereof.

By the quaternation there is introduced preferably at least one methyl or ethyl group. Particular uptake assistants worth mention are the following: tallow fatty aminopropylamine oxyethylated with 30 to 35 moles of ethylene oxide and monoquaternated with dimethylsulphate; tallow fatty aminopropylamine, oxyethylated with 100 moles of ethylene oxide, behenylaminopropylamine and/or arachidylaminopropylamine oxyethylated with 100–105 moles of ethylene oxide; The non-quaternary uptake assistants are preferred for the process of the invention. Per 100 parts by weight of the hydrosoluble sulpho group-containing sulphur dye, there are employed preferably 5–100 parts by weight, more preferably 10–50 parts by weight of the dye-substantive uptake assistant.

The dyeing is carried out in aqueous medium, advantageously under mild temperature conditions, preferably in the temperature range of from 15°–50° C., more preferably in the range of 20° to 40° C.; the pH-value lies mainly in the range of 3.5 to 9, preferably in the range of from 4.5 to 8, the lower pH-values being preferred for substrates with a stronger and more compact fibrous structure (e.g. for box leather from cow), the higher pH-values being preferred for substrates with a less compact fibrous structure (e.g. for split velours-)—analogously as described above for the "neutralization" of the leather The pH in the cut-edge is generally lower than the pH of the liquor. The dye concentration may range in a very broad scope and may be chosen depending on the substrate and on the desired colour effect; the dye concentration lies in general preferably in the range of from 0.05 to 10% referred to the wet weight of the leather. The optimum choice of dye, assistant and parameters (concentration, temperature, pH, duration of the dyeing, and liquor-to-goods ratio) to obtain an optimum full-penetration dyeing may be determined by a few preliminary tests.

Subsequent to the treatment with the hydrosoluble sulpho groupcontaining sulphur dye, the leather is preferably after-treated in the dye-bath with an acid: for example with hydrochloric acid, acetic acid or preferably formic acid, at pH-values preferably in the range of 2.5–5. The treated leather may then be washed or rinsed with water and, upon drying, finished in the usual way. If desired the dyed leather may be fatted, hydrophobized and/or finished with an elastic polymer film or a gloss topping. If desired the fatting step, in particular with sulphonation products of natural fats or oils, may also be carried out simultaneously with the dyeing with the hydrosoluble sulphogroup containing sulphur dye.

Leathers dyed as described above, especially also leathers of medium thickness and very thick leathers (in particular those of a thickness of 1 mm or more), are penetration-dyed surprisingly well and in high yield and are of optimum fastness They are, however, particularly suitable (in the wet or also in the dry state) as substrates for further coloration processes in particular dyeings or printings, advantageously with hydrosoluble leather dyes, in particular dyes displaying a medium to high affinity for leather, and which may be of anionic or basic (including cationic) character. Of the anionic dyes, there may be mentioned in particular sulpho group-containing sulphur dyes suitable as dyes for leather and wool (mainly the ones as described above), azo dyes and metal complexes of azo dyes as defined in the Colour Index under the titles Acid Dyes, Mordant Dyes, Solubilized and Condense Sulphur Dyes and optionally Direct Dyes. As dyes with basic or cationic character are suitable in general any such dyes as usually employed for the dyeing of leather (see also Colour Index: Basic Dyes) in particular also metal complex dyes of high affinity. Of the dye classes mentioned for the further dyeing of the leather there are preferred hydrosoluble sulpho group-containing sulphur dyes and the hydrosoluble cationic dyes. The cationic dyes are particularly preferred, especially those which contain on average more than one cationic charge, preferably at least 1.3, more preferably at least 1.5 cationic charges per dye molecule, such as described in European Patent Application No. 41040 A1 (in particular formulae III and IV thereof) and No. 92520 A2 [in particular formula II thereof, preferably with a radical of the there defined formula (aa 7) in the molecule] are incorporated herein by reference.

For the overdyeing of the penetration-dyed leather with anionic or basic dyes, aqueous solutions of the dyes (optionally in the presence of conventional dyeing assistants) may be applied to the leather by known methods e.g. by spraying or coating or preferably by a further exhaust dyeing in a corresponding dye bath. The overdyeing in such dye baths may be carried out under standard dyeing conditions for example with dye concentrations in the range of 0.02–2% of the wet weight of the substrate and dyeing temperatures in the range from room temperature (=20° C.) to 70° C. preferably in the range of from 40° to 60° C. According to a particular aspect of the process of the invention the material overdyed with a basic or cationic dye is further overdyed with a hydrosoluble sulpho group-containing sulphur dye as described above. For the second overdyeing the dye concentration may also be higher than the concentration for the first overdyeing e.g. up to 4% referred to the wet leather; however, with concentrations in the range of 0.02–2 % very good results may be achieved.

The overdyeing of the leathers may be completed as described above and the treated leather may, if desired, be refatted, hydrophobized and/or optionally finished with a special topping, e.g. to obtain a particular gloss, a water-repellent finishing, and/or an abrasion-resistant finishing For the final fatting there may be also employed phosphoric acid partial esters of optionally oxyethylated higher fatty alcohols, e.g. as described in No.

DE 32 30 925 A; for special toppings there may be used hardenable lacquers as described e.g. in No. DE 32 40 279 A or hardenable hydrosoluble polyurethanes If the penetration-dyed leather is fatted before overdyeing with a basic dye, cationically emulsified fatliquors may also be used for this purpose.

According to a further particular aspect of the process of the invention for penetration-dyeing and overdyeing, the leather, in particular very thin leather, may be dyed in the first stage, i.e. with the hydrosoluble sulphogroup-containing sulphur dye, in the absence of the dye-substantive uptake assistant. In this case hydrosoluble basic or cationic dyes are preferred for the overdyeing. This variation of the inventive process is not preferred. Instead it is preferred to carry out the penetration dyeing in the presence of the dye-substantive uptake assistant.

With the inventive combination of penetration dyeing and overdyeing, there may be achieved a large number of colour effects; particularly interesting is the overdyeing of the penetration-dyed leather to the same shade, especially by so-called sandwich dyeings, by which superficial damage that may occur during the use of the leather remains as far as possible invisible. The dyeing variation with two overdyeings as defined above—i.e. in particular a first overdyeing with a cationic dye in the same shade as the penetration dyeing as described above and a second overdyeing in the same shade with a hydrosoluble sulphogroup-containing sulphur dye, preferably with the same dye as used for the penetration dyeing,—yields dyeings of particularly high quality and is correspondingly indicated mainly for leathers of high quality such as garment leather and furniture leather. In the penetration dyeing of wool-bearing leathers and of furs, it may occur with some sulphur dyes that the leather is penetration-dyed, whereas the hair is only slightly coloured; if in such a case it is desired to dye the hair in the same shade as the leather, this may be achieved according to the invention by the use of a corresponding dye with high affinity for wool fibers for the overdyeing.

The penetration dyeings obtainable according to the invention, and in particular the overdyeings, display optimum fastness properties such as are obtainable on leather, with the single dyes used for the penetration dyeing and for the overdyeing of the leather; the fastnesses may even be improved if for the overdyeing there is used a basic, or cationic dye, and in particular if in a second overdyeing there is used a hydrosoluble sulpho group-containing sulphur dye as defined above. Particularly worth mentioning are wet-fastness properties such as fastness to perspiration, to washing, to wet rubbing and to water drops and further fastnesses such as light-fastness, fastness to dry cleaning, fastness to dry rubbing, migration resistance on polyvinyl chloride and fastness to acetone.

In the following examples the percentages are by weight and they refer to the substrate (i.e., if not otherwise indicated, to the wet leather) if they do not indicate the concentration of a solution; the dyestuff concentrations are indicated as concentrations of active substance.

EXAMPLE 1a (drum dyeing)

Chrome-tanned cow leather of 2.2 mm thickness is adjusted to pH 4.5 to 5.5 in 150% water with 0.5% of sodium formate and 0.8% of sodium bicarbonate and the bath is drained off. For retanning there are added 150% water, 4% Relugan RE [a poly(meth)acrylate resin of BAYER AG], 3% mimosa extract and 1% di(sulphonaphthyl)resin methane (a dispersing agent) and retanning is continued for 40 minutes at 35° C.; then the bath is drained off and the leather is fatted with 150% water and 10% fatting substances (7.5% sulfited fish oil, 2% sulphated coconut oil and 0.5% neat's foot oil) for 90 minutes then acidified with 1% formic acid and treated for further 30 minutes under these conditions. The bath is drained off and the leather is dyed with 150% water, 1.8% Colour Index Solubilized Sulphur Black 1 and 2% of a dye-substantive uptake assistant of formula (I) in which R is a mixture of behenyl and arachidyl, q is 3 and the sum of $m+n+p=105$, at 25° C. for 120 minutes, upon which a full penetration dyeing is achieved; after acidification by addition of 100% water and gradually 3% formic acid (of 85% concentration) the treatment is continued for 60 minutes at 50° C. The bath is drained off and the leather is washed with 300% water for 5 minutes at 50° C.

The leather is dried hanging and cured in the usual way. It is dyed to full penetration in a regular black shade.

EXAMPLE 1b

The procedure of example 1a is followed up to the 5 minutes washing with 300% of water; then the bath is drained off and the leather is dyed with 200% of water and 0.5% of the dye of example 35a of No. EP 92520 A2 for 20 minutes at 50° C. Then the leather is rinsed, dried and cured as usual.

The leather so obtained is dyed to full penetration in black and overdyed in black and displays very high fastnesses.

EXAMPLE 2a (Drum dyeing)

Chrome-tanned cow leather of 2.2 mm thickness is treated for 20 minutes at 40° C. with 200% of water and 1% sodium formate. Upon addition of 1% sodium sulphate and 0.2% sodium bicarbonate, treatment is continued for 45 minutes at 40° C. (the leather is "neutralized"). The pH in the cut edge of the leather is 4.8 to 5. The bath is drained off and the leather is rinsed with 300% of water for 10 minutes at 40° C. Then, the bath is drained off and the leather is dyed with 100% water, 2% C.I. Solubilized Sulphur Black 1, and 2% of the same dye-substantive uptake assistant of formula (I) as used in example 1a for 360 minutes at 40° C. upon which a full penetration dyeing is achieved. Thereupon, the leather is fatted with 100% water, 3% Relugan RE, and 5% of fat substance (sulphited fish oil) for 45 minutes at 40° C. and then for acidification there are added 100% of water and gradually 2% of formic acid of 85% concentration and treatment is continued for 30 minutes at 40° C. The bath is drained off and the leather is washed with 300% of water for 5 minutes at 25° C. dried and cured as usual.

EXAMPLE 2b

The procedure of example 2a is followed up to the 5 minutes washing with 300% of water then the bath is drained off and the leather is dyed with 200% of water and 0.5% of the dye of example 35a of No. EP 92520 A2 for 20 minutes at 50° C. Then the leather is rinsed, dried and cured as usual.

The so dyed leather is dyed to full penetration in black and overdyed in black and displays very high fastnesses.

In the following table there are enumerated further examples of dyeings of the invention that are carried out analogously as described in the above examples 1a and 1b, examples 3a, 4a, 5a, 6a, 7a, 8a and 9a being carried out analogously as described in example 1a, and are the penetration dyeings with the corresponding sulphur dyes, whereas examples 3b, 4b, 5b, 6b, 7b, 8b and 9b, are the overdyeings with the indicated cationic dyes, and are carried out analogously as described in example 1b.

| Example | Sulphur dye (Colour Index Solubilized Sulphur) | concentration % | cationic dye of EP 41 040 A1 | concentration % | shade of the penetration-dyeing and of the overdyeing |
|---|---|---|---|---|---|
| 3a + 3b | Brown 14 | 1,8% | of example 128 of EP 41040 | 0,5% | black-brown |
| 4a + 4b | Red 6 | 1,8% | of example 139 of EP 41040 | 0,5% | reddish brown |
| 5a + 5b | " | 1,8% | of example 141 of EP 41040 | 0,5% | reddish brown |
| 6a + 6b | Brown 10 | 1,8% | of example 151 of EP 41040 | 0,5% | reddish yellow |
| 7a + 7b | Brown 14 | 1,8% | of example 154 of EP 41040 | 0,5% | olive brown |
| 8a + 8b | " | 1,8% | of example 157 of EP 41040 | 0,5% | brown |
| 9a + 9b | Brown 10 | 1,8% | of example 157 of EP 41040 | 0,5% | brown |

EXAMPLE 10

(Drum dyeing)

The pH of chrome-tanned calf leather of 1.8 mm thickness is adjusted to pH 4.5–5.5 by treatment with 100% water and 0.8% of sodium formate for 15 minutes and then with 0.8% sodium bicarbonate for further 35 minutes at 35° C. The bath is drained off and the leather is treated with 150% water and 2% of the dye-substantive uptake assistant of formula (I) used in example 1a for 15 minutes at 25° C.; then, there are added 200% of water, 2% C.I. Solubilized Sulphur Blue 11 and 3% fatty substances (2% sulphited fish oil and 1% sulphated coconut-oil) at 35° C., and the dyeing and fatting treatment is continued for 45 minutes at this temperature upon which full penetration dyeing is obtained; then 1% formic acid are added for acidification and the treatment is continued for 30 minutes. The bath is drained off and the leather is overdyed by treatment with 200% of water of 50° C. and 0.5% C.I. Solubilized Sulphur Blue 11 for 30 minutes at 50° C.; after addition of 1% formic acid the treatment is continued for further 20 minutes. The bath is drained off and the leather is rinsed, dried, and cured as usual. The obtained dyeing is of optimum fastness.

EXAMPLE 11

(Drum dyeing)

(The percentages refer to the dry weight of the leather) Chrome-tanned and synthetically retanned split leather of 1.6 mm thickness is dyed by treatment with 200% of water of 40° C., 3% ammonia, 2% of the same dye-substantive uptake assistant of formula (I) as used in example 1a, and 0.8% of C.I. Solubilized Sulphur Red 6 for 60 minutes at 40° C. Thereupon 400% of water of 50° C. with 2% of sulphated coconut oil are added to the same bath; after 20 minutes there are added 1.5% of formic acid and the treatment is continued for further 30 minutes. The bath is drained off. Then, the leather is dyed with 600% of water of 50° C., 0.24% of the red dye of formula

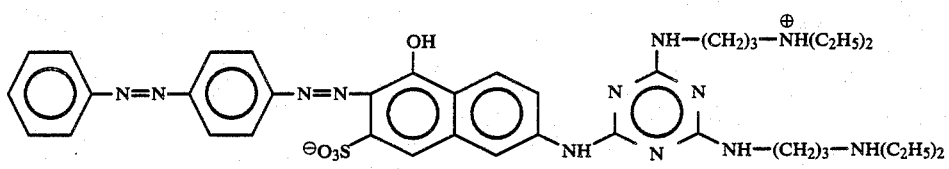

(1)

and 1% of formic acid for 60 minutes at 50° C. The bath is then drained off and the leather is rinsed, dried and cured as usual. The obtained leather is red penetration dyed and red overdyed, with optimum fastnesses.

EXAMPLE 2

The procedue of example 11 is repeated using, C.I. Solubilized Sulphur Blue 11 in place of C.I. Solubilized Sulphur Red 6, and the dye of formula

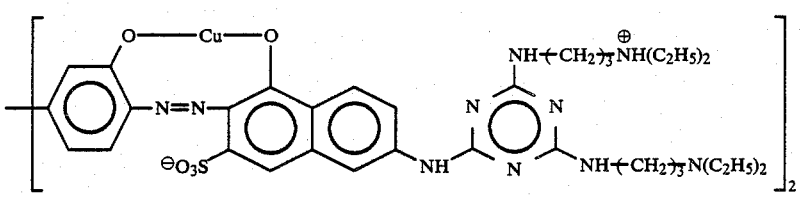

(2)

in place of the dye of formula (1). The resulting blue penetration dyed and overdyed leather has optimum fastnesses.

EXAMPLE 13

The procedure of example 12 is repeated using, 0.60% of the turquoise dye of formula (3)

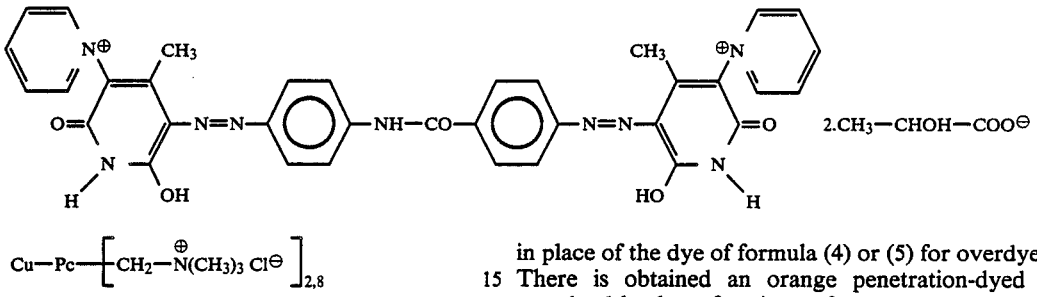

and 0.08% of the black dye of example 35a of No. EP 92520 A2 in place of the blue dye of formula (2). The resulting blue penetration dyed and overdyed leather has optimum fastnesses.

EXAMPLE 14

The procedure of examples 1a and 1b is repeated using, C.I. Solubilized Sulphur Yellow 23 in place of C.I. Solubilized Sulphur Black 1 in example 1a for penetration-dyeing and using in example 1b in place of the dye of example 35a of No. EP 92520 A2 the yellow dye of formula (4)

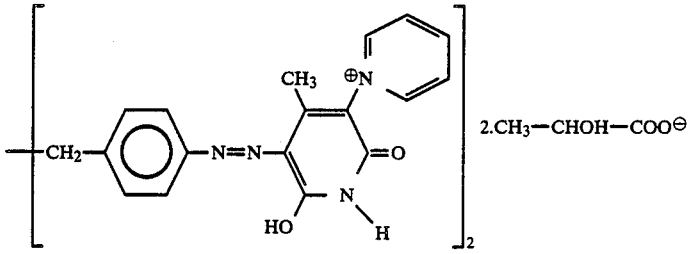

or the yellow dye of formula (5)

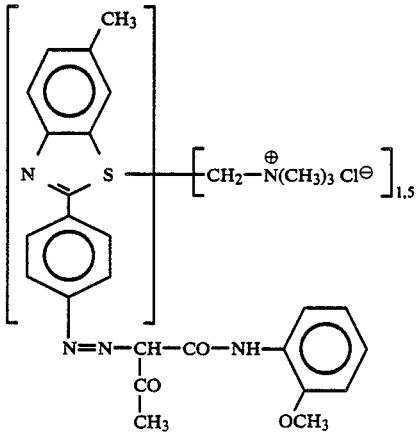

for overdyeing.

There is obtained a yellow penetration dyed and overdyed leather with optimum fastnesses.

EXAMPLE 15

The procedure of example 14 is repeated by using, C.I. Solubilized Sulphur Orange 5 in place of C.I. Solubilized Sulphur Yellow 23 for penetration dyeing, and the orange dye of formula (6)

in place of the dye of formula (4) or (5) for overdyeing. There is obtained an orange penetration-dyed and overdyed leather of optimum fastnesses.

EXAMPLE 16

The procedure of example 11 is repeated using, C.I Solubilized Sulphur Black 1 in place of C.I. Solubilized Sulphur Red 6 for penetration dyeing and using the dye of example 35a of EP 92520 A2 in place of the dye of formula (1) for overdyeing. There is obtained a black penetration-dyed and black overdyed leather of optimum fastnesses.

EXAMPLE 17

The procedure example 16 is repeated up to the rinsing. After the rinsing the dyed leather is further overdyed in 200% water with 0.5% C.I. Solubilized Sulphur Black 1 at 50° C. for 30 minutes and then is acidified with 1% formic acid and the treatment is continued for further 20 minutes. The bath is drained off and the leather is rinsed, dried and cured as usual.

There is obtained a black penetration-dyed and black overdyed leather of excellent fastnesses.

EXAMPLE 18

(Drum dyeing)

(The indicated percentages refer to the dry weight of the leather if they do not indicate the concentration of a solution). Sheep nappa-crust is milled in 1000% water at 50° C. with 2% of ammonia (of 25% concentration) and 0.5% octylphenoldecaglycolether for 60 minutes and then the bath is drained off. Subsequently the leather is treated for 10 minutes at 50° C. with 800% water and 2% of a fatting substance (sulphated coconut oil) after which the leather is dyed by addition of 2% C.I. Solubilized Sulphur Black 1 at 40° C. for 60 minutes. Then the bath is acidulated gradually with 3% formic acid (of 85% concentration) and the treatment is continued for further 30 minutes. The bath is drained off and then the leather is overdyed with 600% of water and 1% of the dye of example 35a of No. EP 92520 A2 for 20 minutes at 50° C. Then the leather is rinsed, dried and cured as usual.

The so dyed leather is black penetration dyed and black overdyed with optimum fastnesses.

What is claimed is:

1. A process for the penetration dyeing of tanned leather which comprises dyeing the tanned leather in an aqueous medium with a hydrosoluble sulpho group-containing sulphur dye in the presence of a dye-substantive uptake assistant which is a surface-active quaternized or non-quaternized fatty amine or fatty aminoalkylamine, said amine or aminoalkylamine containing an aliphatic linear hydrocarbon radical of at least 12 carbon atoms and being oxyethylated with at least 20 moles of ethylene oxide per mol and the alkylene bridge of said aminoalkylamine being linear polymethylene of 2 to 6 carbon atoms.

2. A process according to claim 1, wherein the dye substantive uptake assistant is a compound of the average formula

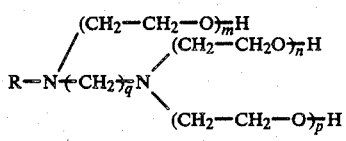

(I)

wherein

R signifies alkyl or alkenyl with 16 to 22 carbon atoms q is a whole number from 2 to 6 m, n and p are each at least 1 and the sum m+n+p is 20 to 110 or a quarternized product thereof.

3. A process according to claim 2 wherein the pH of the leather prior to the dyeing is in the range 4 to 9.

4. A process according to claim 3 wherein the dyeing is carried out a temperature in the range of 15° to 50° C. and a pH in the range 3.5 to 8 .

5. A process according to claim 2 wherein the dyeing is carried out at a temperature in the range of 15° to 50° C. and a pH in the range 3.5 to 9.

6. A process according to claim 5 wherein the leather is of a thickness of at least 1 mm.

7. A process according to claim 6 wherein 5 to 100 parts by weight of dye-substantive uptake assistant are used per 100 parts by weight hydrosoluble sulpho group-containing sulphur dye.

8. A process according to claim 7 wherein the pH of the leather prior to the dy eing is in the range 4 to 9.

9. A process according to claim 7 which comprises the further step of aftertreating the dyed leather in the dyebath with an acid at a pH in the range of 2.5 to 5.

10. A process which comprises overdyeing or overprinting with a cationic dye containing on average at least 1.3 cationic charges per molecule a leather substrate which has been treated according to the process of claim 9.

11. A process according to claim 2 wherein the leather is of a thickness of at least 1 mm.

12. A process according to claim 11 wherein the dyeing is carried out at a pH in the range 3.5 to 8.

13. A process according to claim 2 wherein 5 to 100 parts by weight of dye-substantive uptake assistant are used per 100 parts by weight hydrosoluble sulpho group-containing sulphur dye.

14. A process according to claim 2 wherein the due-substantive uptake assistant is tallow fatty aminopropylamine oxyethylated with 30 to 35 moles of ethylene oxide and monoquaternated with dimethylsulphate; tallow fatty aminopropylamine oxyethylated with 100 moles of ethylene oxide; or behenylamino-propylamine and/or archidylaminopropylamine oxyethylated with 100 to 105 moles of ethylene oxide.

15. A process according to claim 2 which comprises the further step of aftertreating the dyed leather in the dyebath with an acid at a pH in the range of 2.5 to 5.

16. A process which comprises overdyeing or overprinting with an anionic or basic dye a leather substrate which has been penetration-dyed according to the process of claim 2.

17. A process according to claim 2 wherein the dye-substantive uptake assistant is a mixture of compounds of formula (I) wherein R is arachidyl and behenyl, q is 3 and the sum of m+n+p is 105.

18. A process which comprises further dyeing or printing a leather substrate which has been penetration-dyed according to the process of claim 1.

19. A process which comprises overdyeing or overprinting with an anionic or basic dye a leather substrate which has been penetration-dyed according to the process of claim 1.

20. A process according to claim 19 in which the penetration-dyed leather is overdyed from aqueous medium with a hydrosoluble basic dye.

21. A process according to claim 19 wherein the penetration-dyed leather is overdyed from aqueous medium with a hydrosoluble basic dye and then further overdyed with a hydrosoluble sulphogroup-containing sulphur dye from aqueous medium.

22. A process according to claim 1 which comprises the further step of fatting the tanned leather before, during or after the penetration dyeing.

23. A process according to claim 22 wherein sulphonated natural fats or oils are used for fatting.

24. A process for dyeing tanned leather which comprises dyeing very thin leather with hydrosoluble sulpho group-containing sulphur dyes from aqueous medium in the absence of a dye-substantive uptake assistant and overdyeing said leather with a hydrosoluble basic dye.

25. Tanned leather dyed by a process according to claim 1.

26. Tanned leather dyed by a process according to claim 19.

27. Tanned leather dyed by a process according to claim 21.

28. Tanned leather dyed by a process according to claim 24.

* * * * *